US007320156B1

(12) United States Patent
Slayton

(10) Patent No.: US 7,320,156 B1
(45) Date of Patent: Jan. 22, 2008

(54) BIB HOLDER INCORPORATING A COMPARTMENT

(76) Inventor: Emily Slayton, 370 E. 76th St., New York, NY (US) 10021

( * ) Notice: Subject to any disclaimer, the term of this patent is extended or adjusted under 35 U.S.C. 154(b) by 60 days.

(21) Appl. No.: 10/913,254

(22) Filed: Aug. 6, 2004

Related U.S. Application Data

(60) Provisional application No. 60/582,637, filed on Jun. 23, 2004.

(51) Int. Cl.
*A45F 5/04* (2006.01)
*A44B 21/00* (2006.01)

(52) U.S. Cl. ..... 24/7; 24/298; 24/302

(58) Field of Classification Search ..... 24/3.1, 24/3.4, 3.7, 3.8, 3.13, 7, 298–302
See application file for complete search history.

(56) References Cited

U.S. PATENT DOCUMENTS 211,479 A * 1/1879 Shelby ..... 2/335
1,184,311 A * 5/1916 Boch ..... 224/222
1,418,371 A * 6/1922 Foster ..... 224/182
4,446,574 A * 5/1984 Kalomeris ..... 2/338
5,201,073 A * 4/1993 Spanier ..... 2/49.2
5,313,669 A * 5/1994 Rasdell et al. ..... 2/323
5,540,366 A * 7/1996 Coomber ..... 224/677
5,692,246 A * 12/1997 Benedick ..... 2/463
H1738 H * 7/1998 Reinhart, Jr. ..... 2/49.1
5,839,932 A * 11/1998 Pierce et al. ..... 441/80
5,852,849 A 12/1998 Lansing et al. ..... 24/3.4
5,871,132 A * 2/1999 Hargreaves ..... 2/46
5,913,478 A 6/1999 Ochsman ..... 24/7
5,938,089 A * 8/1999 Abreu-Marston ..... 224/148.5
6,182,335 B1 2/2001 Juda et al. ..... 24/7
6,325,260 B1 * 12/2001 Gorham ..... 224/222
6,371,346 B1 * 4/2002 Sharma ..... 224/578
6,502,284 B2 1/2003 Juda et al. ..... 24/7
6,718,554 B1 * 4/2004 Langston ..... 2/49.1

* cited by examiner

*Primary Examiner*—James R. Brittain
*Assistant Examiner*—Ruth C. Rodriguez
(74) *Attorney, Agent, or Firm*—Wilmer Cutler Pickering Hale and Dorr LLP

(57) ABSTRACT

A bib holder is provided that is useful for securing a bib in place. In one embodiment, the bib holder includes a strap and at least one fastener that is useful for retaining the bib, in addition to at least one compartment that is capable of storing an item of suitable size and weight. The compartment can be attached to the strap, or be a part of the fastener. In various embodiments, at least a portion of the surface of the compartment is reflective. Additionally, the compartment of the bib holder can optionally include indicia thereon. In certain embodiments of the invention, moreover, the compartment includes a plurality of sub-compartments.

26 Claims, 11 Drawing Sheets

BIB HOLDER INCORPORATING A COMPARTMENT

CROSS REFERENCE TO RELATED APPLICATION

This application claims the benefit under 35 U.S.C. § 119(e) of U.S. Provisional Patent Application No. 60/582,637, filed Jun. 23, 2004, which is hereby incorporated by reference herein in its entirety.

FIELD OF THE INVENTION

The present invention relates generally to bib holders. More particularly, this invention relates to holders for bibs that incorporate one or more compartments useful for storage of one or more items.

BACKGROUND OF THE INVENTION

It is often desirable to use a bib for the purpose of protecting a person's clothing. A bib can be, for example, a piece of cloth or other material, such as plastic. Moreover, a bib can be secured under the chin of a person and worn to protect the person's clothing while eating or performing other activities. Such bibs are especially useful in protecting the clothing of small children and elderly persons, although all types of persons can benefit from the use thereof for any of a variety of reasons. For example, bibs are commonly used by persons of all ages in non-eating situations, such as during a medical or dental procedure.

Generally, traditional bibs are held in place by bib holders that include straps (or neckbands) made from various materials, which are often supported by the nape of a person's neck. These bib holders often include fasteners at the ends of the straps for securing, or retaining the bibs in place. While such bib holders generally function well to hold bibs in place, it has recognized that it is desirable to provide bib holders with additional functionality, such as to display a logo as described in U.S. Pat. No. 5,852,849 to Lansing et al., for example.

As another example, U.S. Pat. Nos. 6,182,335 and 6,502,284, both to Juda et al., each describe a clothing protective device that includes a small case, generally in the form of a cylindrical element, constituted of two separate halves attached by a string, and that incorporates elements for the attachment of a clothing protective article to the device, such as a napkin or the like, and the storage of a toothpick.

In light of the foregoing, it is desirable to provide bib holders that are adapted to perform additional functions in addition to securing a bib in place, displaying a logo, or storing a toothpick.

SUMMARY OF THE INVENTION

In accordance with the principles of the present invention, a bib holder is provided for securing a bib to a user. In one embodiment of the invention, the bib holder includes a strap having two ends, two fasteners, each fastener being attached at a unique end of the strap, and a compartment that is attached to the strap. Alternatively, the bib holder can include a strap having two ends, a fastener that is attached at both ends, and a compartment that is attached to the strap.

In other embodiments of the invention, the bib holder includes a strap having two ends, and two fasteners, each fastener being attached at a unique end of the strap, wherein at least one of the fasteners comprises a compartment.

In yet other embodiments of the invention, the bib holder includes a strap having two ends, two fasteners, each fastener being attached at a unique end of the strap, a compartment that is attached to the strap, and a reflective component that is attached to the strap, wherein at least a portion of the outer surface of the reflective component is reflective.

In still other embodiments of the invention, the bib holder includes a circular strap that is capable of encircling the neck of a wearer of the bib holder, a fastener that is attached to the strap, and a compartment that is attached to the strap.

BRIEF DESCRIPTION OF THE DRAWINGS

Additional embodiments of the invention, its nature and various advantages, will be more apparent upon consideration of the following detailed description, taken in conjunction with the accompanying drawings, in which like reference characters refer to like parts throughout.

DETAILED DESCRIPTION OF THE INVENTION

Generally speaking, the present invention relates to bib holders and methods for making the same. In the following description, numerous specific details are set forth regarding bib holders in accordance with the present invention, and the environments in which these holders can be used, in order to provide a thorough understanding of the present invention. It will be apparent to one skilled in the art, however, that the present invention can be practiced without such specific details. Moreover, in some instances, well-known components, structures, and techniques have not been shown in detail to avoid unnecessarily obscuring the subject matter of the present invention. It should be understood that these examples are illustrative. It will be understood that other bib holders and methods of making the same that are not specifically described are within the scope of the present invention.

Figure 1:
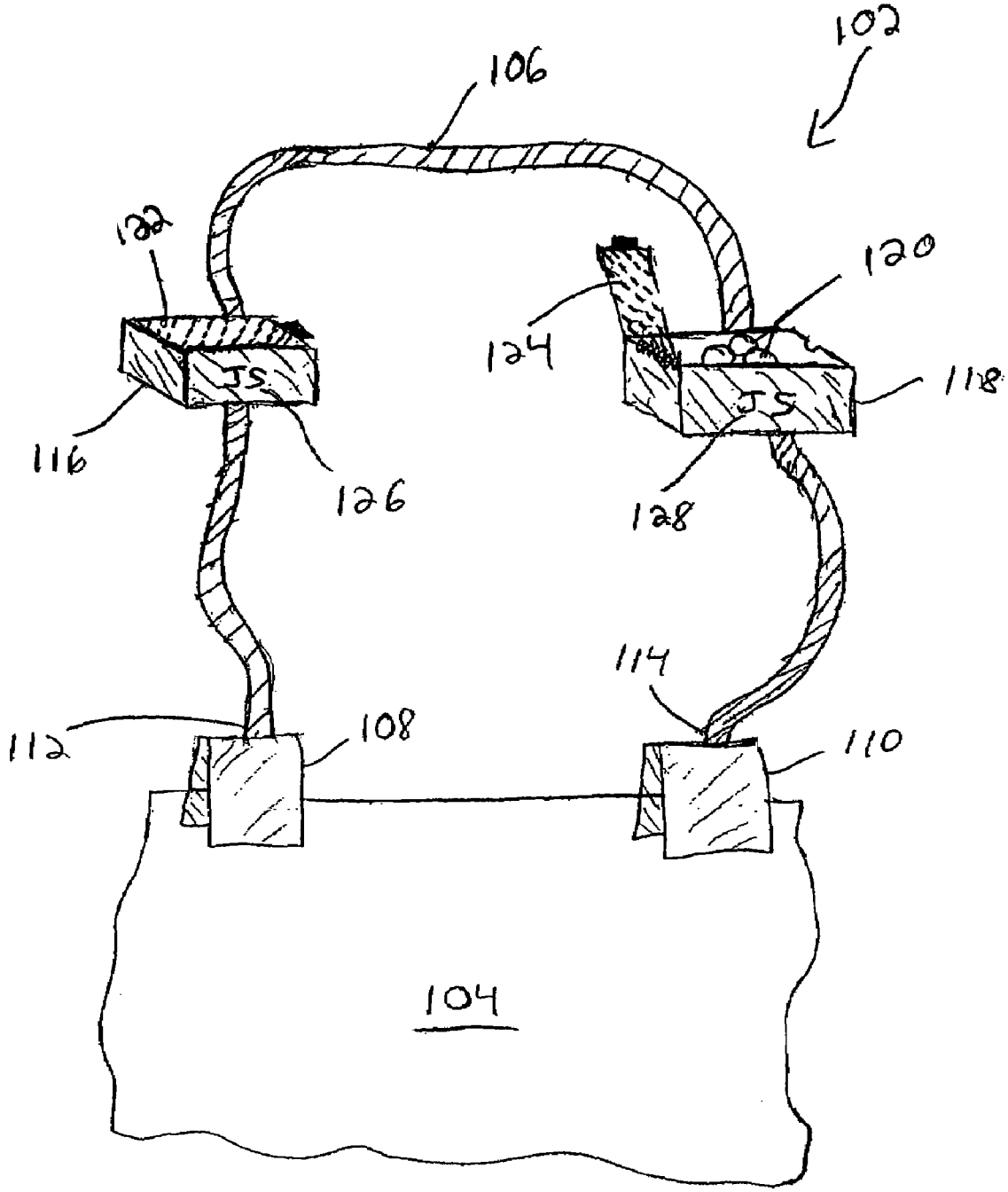
FIG. 1 illustrates one embodiment of a bib holder constructed in accordance with the present invention.

FIG. 1 illustrates a bib holder 102 in accordance with one embodiment of the present invention that is used to secure, or hold, a bib 104 in place on a user. As shown in FIG. 1, bib holder 102 includes a strap 106 and fasteners 108 and 110 that are attached to each end 112 and 114 of strap 106. It should be noted that fasteners 108 and 110 can be attached to strap 106 during the manufacture or construction of these respective components, or fasteners 108 and 110 can be attached to strap 106 in any suitable manner after the manufacture or construction thereof. For example, either or both of fasteners 108 and 110 can be attached to strap 106 via stitches (using any suitable technique to sew fasteners 108 and/or 110 to strap 106), glue, a mechanical interlock, or any other suitable mechanism. Moreover, it will be understood that strap 106 can be formed from any suitable material. For example, the material of strap 106 can include plastic (disposable or otherwise), rubber, metal, rope, covered wire, tubing, or any combination thereof, and can be either elastic or inelastic. Regardless of the particular materials found in strap 106, in certain embodiments of the invention, strap 106 is relatively soft and non-irritating to human skin. Moreover, in other embodiments of the invention, the various components of bib holder 102 are made from lightweight materials so that a person using bib holder 102 does not experience excessive neck strain while supporting bib holder 102.

Fasteners 108 and 110 can be any suitable type of fasteners that are capable of selectively, releasably, or permanently grasping (or otherwise retaining) bib 104. For example, fasteners 108 and 110 can be clips that include one or more teeth, such as found in the clips shown in FIG. 9 and described below. Alternatively, for example, the inner portions of fasteners 108 and 110 can include an adhesive that prevents bib 104 from being released from these fasteners (and thus bib holder 102) unless sufficient force is used to separate the two. In yet other embodiments of the present invention, for example, fasteners 108 and 110 can retain bib 104 using VELCRO strips, buttons, interlocking buckles, snaps, magnets, rubber (or another material for frictionally retaining bib 104), or in any other suitable manner. It will be understood that the invention is not limited by the particular type of fastener 108 or 110 that is used in bib holder 102.

It should be understood that there is no requirement that fasteners 108 and 110 shown in FIG. 1 be the same (or similar) in size, shape, color, style or any other feature. It should also be noted that the invention is not limited by the number of fasteners 108 and 110 that are used in conjunction with strap 106 to retain bib 104. For example, in some embodiments of the invention, ends 112 and 114 of strap 106 can connect to different portions of a single fastener that is used to retain bib 104. Alternatively, for example, one or both of ends 112 and 114 can branch into additional ends, or termini, such that each terminus can be attached to a fastener. In these embodiments, each end is able to connect to multiple fasteners. In various embodiments, therefore, the total number of fasteners used to secure bib 104 can be greater than two. Moreover, fasteners 108 and 110 can be absent altogether in various embodiments of the present invention. For example, strap 106 can be directly attached (e.g., sewn) to bib 104 either during or after the manufacturing process used to create these respective components.

As shown in FIG. 1, bib holder 102 also includes compartments 116 and 118 that are attached to strap 106 and can be used for storing one or more personal items (e.g., medicine pills or other forms of medication, a house or room key, or personal identification information). In general, these personal items can include any suitable type of items that are capable of fitting inside of either compartment 116 or compartment 118, and that are of a suitable weight to be retained therein and supportable by the bib wearer.

In FIG. 1, compartments 116 and 118 are substantially similar, except that compartment 116 is shown in a "closed" state while compartment 118 is shown in an "open" state. It should be noted that while two compartments, 116 and 118, are shown in FIG. 1, this is for illustrative purposes only. In particular, the invention is not limited by the number of compartments used. For example, in other embodiments of the present invention (now shown), one, or more than two, compartments according to the invention can be attached to strap 106 in accordance with the present invention.

Both compartments 116 and 118, as shown in FIG. 1, can be rectangular in shape and at least partially hollow such that medicine pills 120 (or any other suitable items) can be stored therein. In general, compartments 116 and 118 can be attached to strap 106 in any suitable manner (e.g., glued or otherwise attached). Additionally, either or both of compartments 116 and 118 can be removable from strap 106 as desired. In various embodiments of the present invention, moreover, compartments 116 and 118 can be attached to strap 106 such that they remain in an upright position when bib holder 102 is worn. The invention is not limited, however, by the particular orientation of compartments 116 and 118 with respect to the user of bib holder 102.

As shown in FIG. 1, the top, or lid, of compartments 116 and 118 can have a reflective surface (shown as surfaces 122 and 124). Reflective surfaces 122 and 124 can be made from glass or any other reflective or mirrored material. Moreover, it will be understood that the inclusion of reflective surfaces 122 and 124 can be beneficial to a user of bib holder 102 for any number of purposes. For example, either of reflective surfaces 122 or 124 can be used following the completion of a meal to determine whether any food particles have been lodged in between the person's teeth. It should be noted, however, that compartments 116 and 118 are not required to use reflective surfaces as shown in FIG. 1. Accordingly, in other embodiments of the present invention, compartments 116 and 118 can instead be partially or completely non-reflective. Additionally, for example, in one embodiment only one of compartments 116 and 118 have a reflective surface. The invention is not limited in this manner.

Bib holder 102 of FIG. 1 also includes optional indicia 126 and 128 on compartments 116 and 118, respectively. For example, indicium 126 or 128 can include the initials of the person to whom bib holder 102 belongs, or it can include other personal identification information. The use of indicia 126 and 128 is particularly useful in settings such as hospitals or nursing homes where persons might be separated from their respective bib holders 102. In such situations, for example, it is desirable to be able to associate each bib holder 102 with its respective owner, so as to significantly reduce the likelihood that a person will mistakenly consume one or more pills belonging to another person that are being stored in either of compartments 116 or 118. In other embodiments of the present invention, the indicia on either or both of compartments 116 and 118 can include a person's patient number (as assigned by a hospital or nursing home, for example), a date of birth, a list of existing allergies, a room number, or other suitable information and/or markings.

Figure 3:
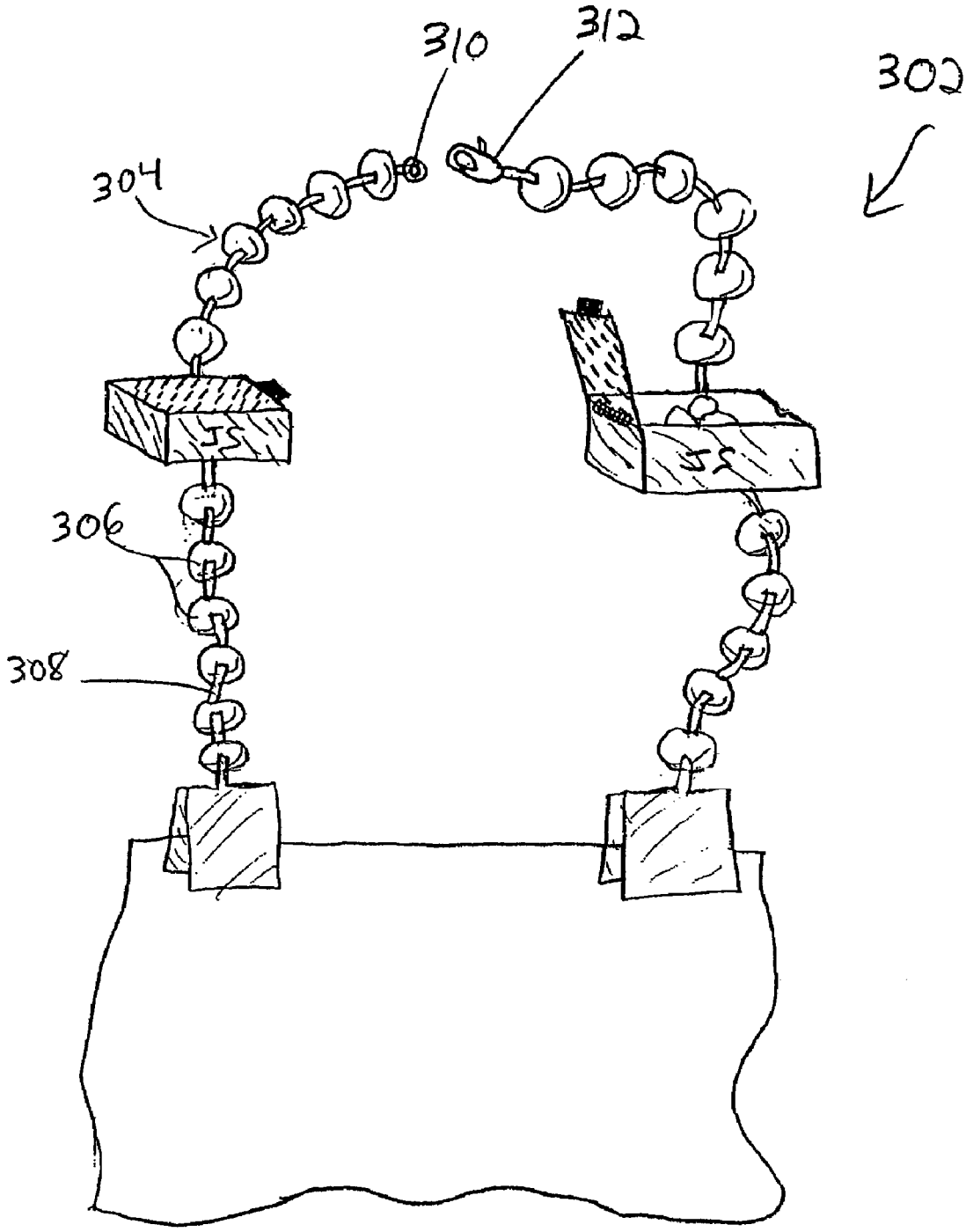
FIG. 3 illustrates yet another embodiment of a bib holder constructed in accordance with the present invention.

It should be understood that the invention is not limited by the particular type of compartment used in the embodiment of the invention shown in FIG. 1. For example, while compartments 116 and 118 shown in FIG. 1 are a particular type of hinged-lid compartments, any other type of compartment that is capable of holding one or more pills or other suitable items, and capable of being attached to strap 106, is within the scope of the present invention. For example, compartments 116 and 118 can be constructed in such a manner that their respective lids can be opened in any direction (rather than a single direction only as shown in FIG. 3). Additionally, for example, either or both of compartments 116 and 118 can use a lid that is completely removable.

Figure 2:
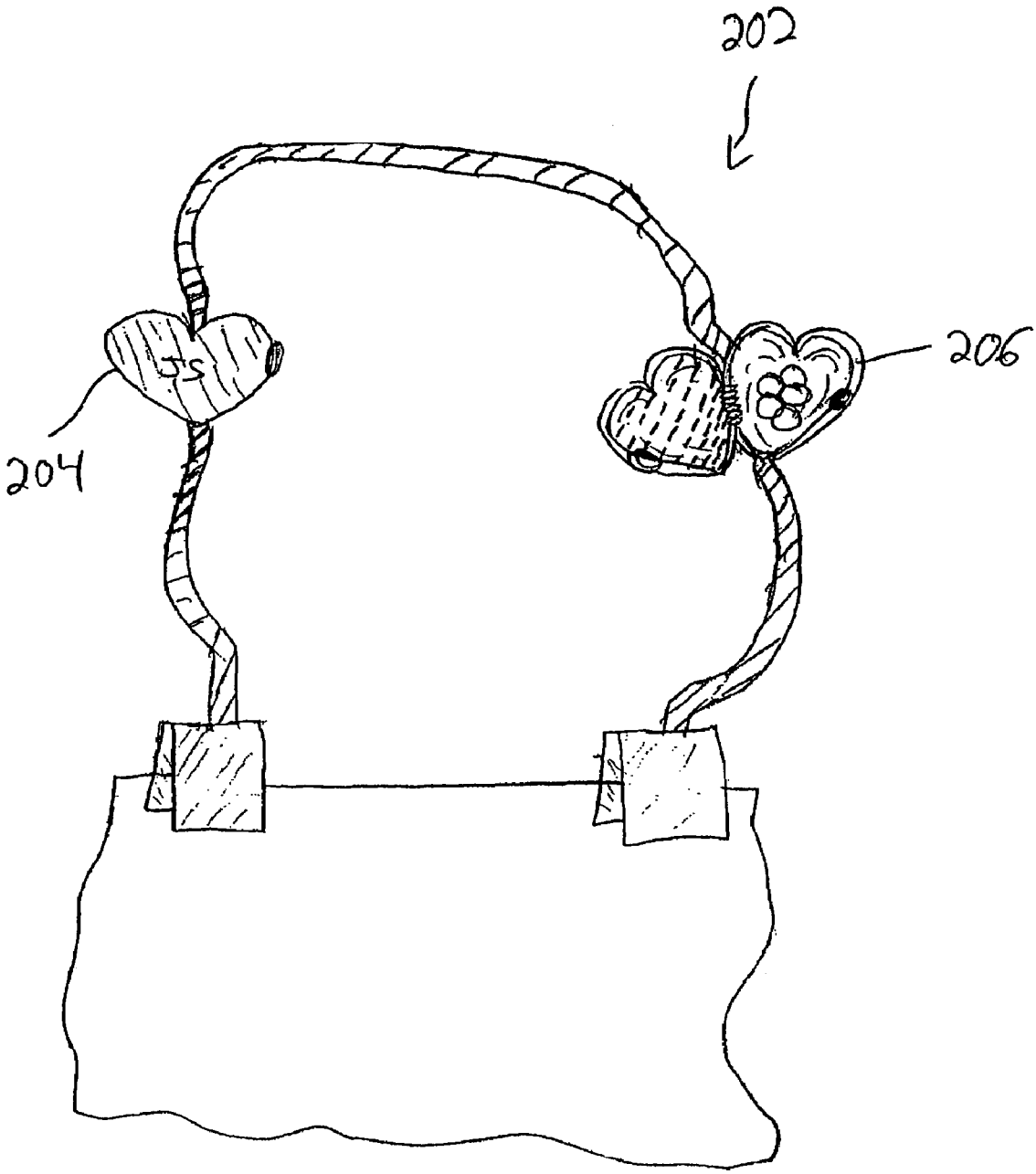
FIG. 2 illustrates another embodiment of a bib holder constructed in accordance with the present invention.

It will also be understood that the invention is not limited by the particular size or shape of either of compartments 116 or 118. For example, FIG. 2 shows a bib holder 202 according to another embodiment of the present invention which is substantially similar to bib holder 102 of FIG. 1, except that compartments 116 and 118 are replaced by ornamental compartments 204 and 206, which are both heart-shaped. It will be understood that any ornamental design is within the scope of the present invention.

In yet other embodiments of the present invention, strap 106 shown in FIG. 1 can be replaced by another, potentially more ornamental strap. For example, FIG. 3 shows a bib holder 302 according to the present invention which includes a strap 304 that is made of from a plurality of beads 306 (which can be pearls or other gem stones, etc., or constructed from relatively inexpensive materials such as plastic, wood, or metal) and a connector 308 (which can be, for example, a thread or metal wire) that connects each of beads 306.

As shown in FIG. 3, strap 304 includes a link 310 and a clasp 312 for connecting the back portion of strap 304 around a person's neck. It will be understood that, although not shown in FIG. 3, strap 304 can include two or more links 310 such that the circumference of the closed strap 304 can be varied by connecting clasp 312 to different ones of the two or more links 310. In this manner, bib holder 302 can be made to properly fit around different sized necks. It will also be understood that the use of link 310 and clasp 312 is not required. For example, instead of using link 310 and clasp 312 to selectively connect the back portion of strap 304 (e.g., the portion of strap 304 that can rest around the nape of a person's neck), this back portion of strap 304 can instead be permanently connected. Alternatively, for example, any other suitable type of connector can be used to selectively connect this back portion of strap 304.

Figure 4:
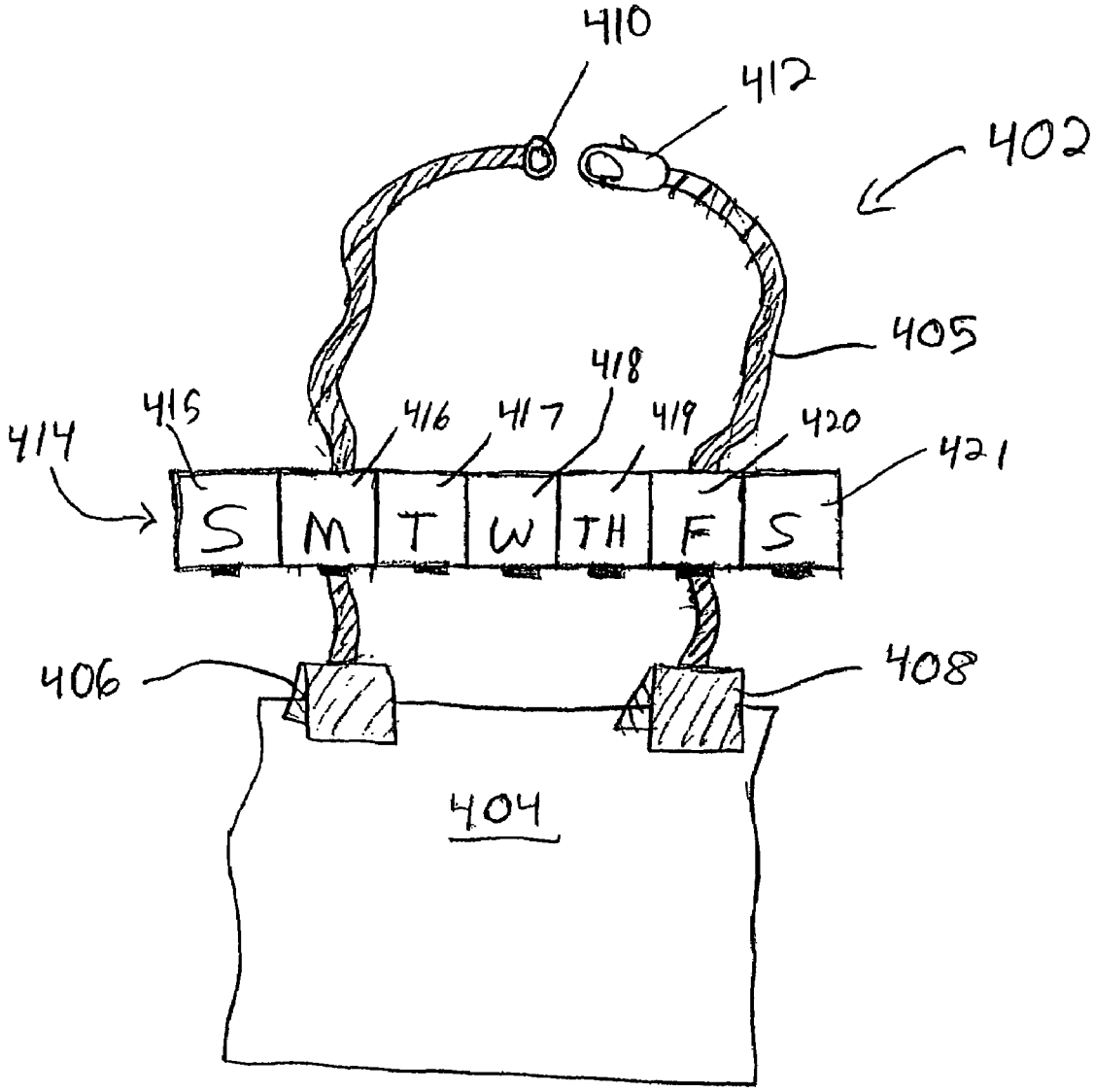
FIG. 4 illustrates still another embodiment of a bib holder constructed in accordance with the present invention.

FIG. 4 shows another bib holder 402 according to the present invention that is used to secure a bib 404 in place. As with bib holder 102 of FIG. 1 described above, bib holder 402 includes a strap 405 and fasteners 406 and 408 that are used to secure a bib 404 in place. Unlike bib holder 102 (and similar to bib holder 302 of FIG. 5), however, bib holder 402 also includes a link 410 and a clasp 412. Persons skilled in the art will appreciate, however, that the invention is not limited in this manner. For example, strap 405 could instead be permanently connected in the portion of strap 405 intended to rest around the nape of a person's neck. In this case, as with all similar embodiments, strap 405 can be at least partially elastic, or of sufficient length, to enable relatively effortless removal and placement of bib holder 402 around a person's head. Additionally, as explained above in connection with bib holder 302 of FIG. 3, bib holder 402 can include additional links 410 such that persons having different sized necks can be better accommodated.

In addition to the above described components, bib holder 402 includes an elongated compartment 414 attached to strap 405 that can be used for storing pills. In general, compartment 414 can be attached to strap 405 in any suitable manner (e.g., glued or otherwise attached). Additionally, either or both ends of compartment 414 can be removable from strap 405 as desired. For example, in one embodiment of the present invention, one of the ends can be permanently attached to strap 405, while the other end is selectively removable to aid in the positioning of bib holder 402 on and off of a person. It should also be noted that, in one embodiment of the invention, elongated compartment 414 is situated such that it rests on a person's chest when bib holder 402 is being worn. However, it will be understood that the invention is not limited in this manner.

As shown in FIG. 4, elongated compartment 414 is partitioned, and includes sub-compartments 415-421, for separately storing medicine pills or other suitable items for each day of the week (i.e., Sunday through Saturday, denoted, for example, by indicia "S," "M," "T," "W," "TH," "F," and "S" in FIG. 4). It will be understood that, in other embodiments of the present invention, a similar elongated compartment can be used that includes less (e.g., one to six) or more sub-compartments than are present in elongated compartment 414 shown in FIG. 4. For example, a person who intends to spend three nights in a hospital might wish to use a bib holder that has only three sub-compartments.

It should also be noted that, as with the other compartments described above, elongated compartment 414 can be attached to strap 405 in any suitable manner. For example, elongated compartment 414 can be glued or otherwise attached to strap 405. Moreover, in various embodiments of the present invention, elongated compartment 414 can be directly connected to fasteners 406 and 408. Moreover, in other embodiments of the present invention, compartment 414 can be directly attached to either one, or more than two, fasteners that can be used to hold bib 404 in place when bib holder 402 is being used by a person.

Figure 5:
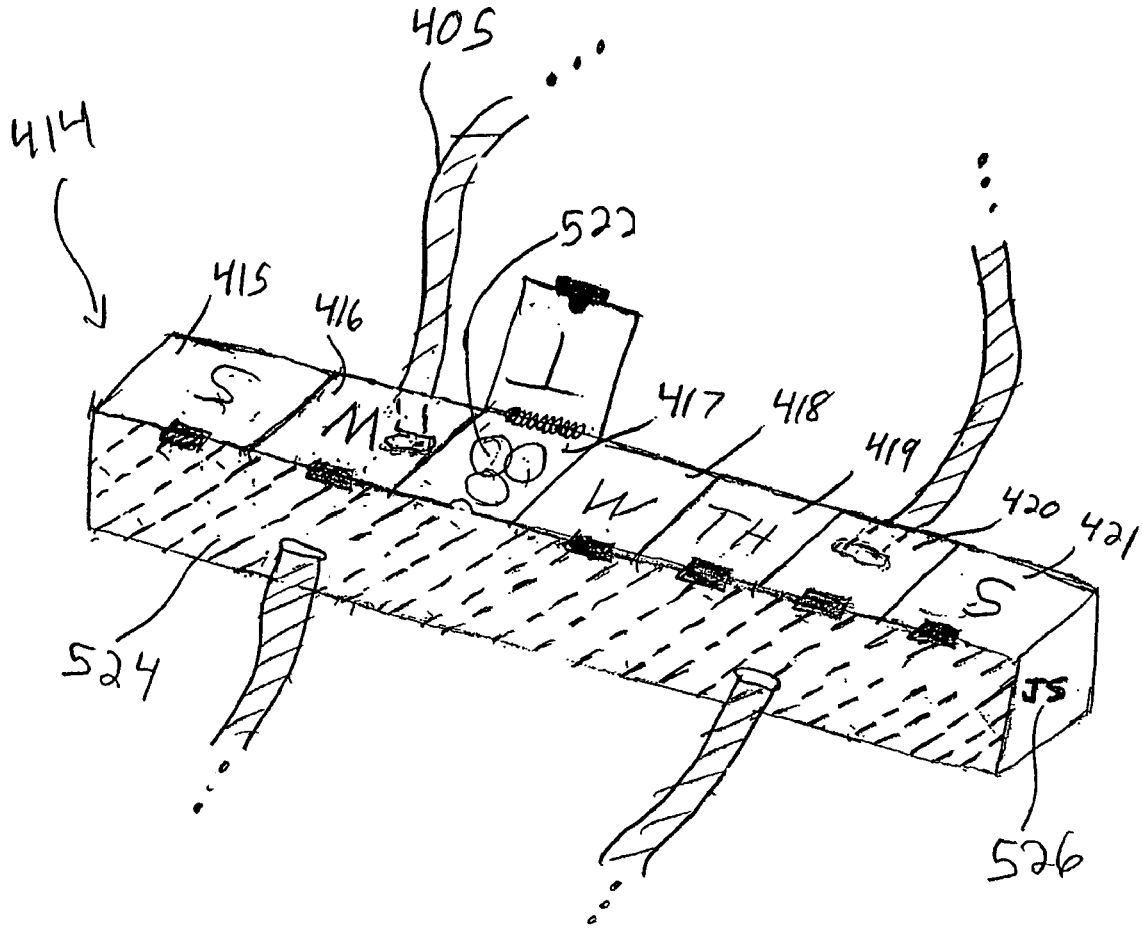
FIG. 5 is a more detailed, perspective view of the elongated compartment illustrated in FIG. 4 according to one embodiment of the present invention.

FIG. 5 shows a perspective view of elongated compartment 414 shown in FIG. 4. As can be seen from FIG. 5, each of sub-compartments 415-421 of elongated compartment 414 is similar in structure to compartments 116 and 118 shown in FIG. 1 and described above. In particular, sub-compartments 415-421 allow for the retention of one or more items such as medicine pills 522 (or any other suitable items).

Sub-compartments 415-421 can be individually constructed and subsequently attached to one another, for example, using glue and/or mechanical connections. Alternatively, for example, elongated compartment 414 can be constructed as a single unit, whereby dividers are used to separate sub-compartments 415-421 (and their respective contents) from one another. As with the other compartments described above, the present invention is not limited by the particular construction of elongated compartment 414, its size, shape or other similar features.

As shown in FIG. 5, elongated compartment 414 can also include a reflective surface 524 (although a reflective surface is not required). Reflective surface 524 can be made from glass or any other reflective or mirrored surface. Moreover, while reflective material is shown in FIG. 5 as extending the entire length of elongated compartment 414, the invention is not limited in this manner. Any portion, or all, of the exterior of elongated compartment 414 can include a reflective surface. Additionally, although not shown, other surfaces of elongated compartment 414 can be reflective.

Elongated compartment 414 also includes optional indicium 526. As with indicia 126 and 128 described above in connection with FIG. 1, indicium 526 can be the initials of a person (as shown in FIG. 7), or can include any other suitable markings or information.

Figure 6:
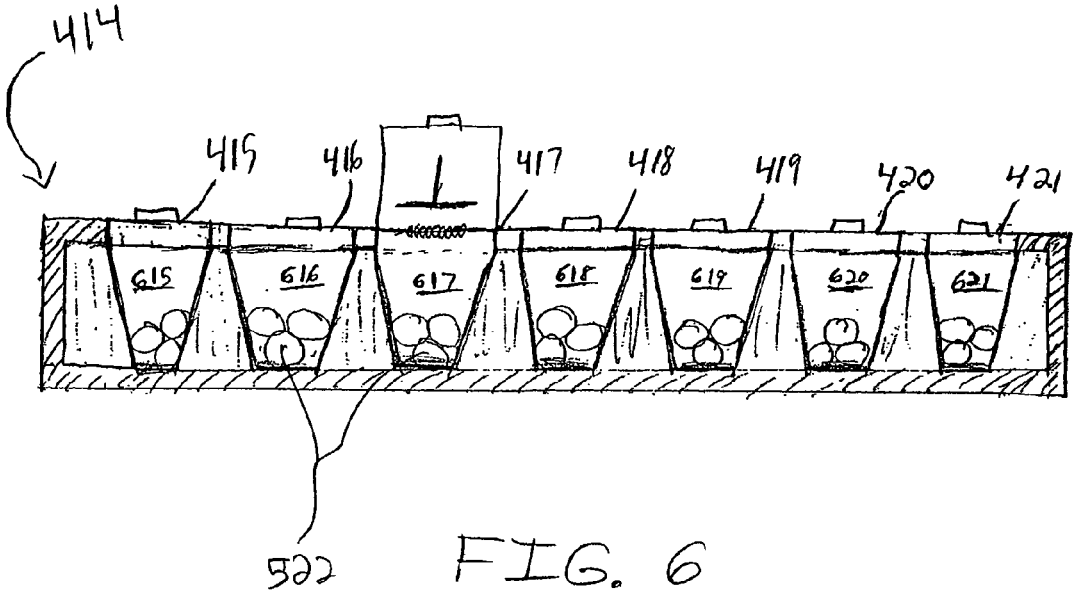
FIG. 6 is a cross-sectional view of the elongated compartment illustrated in FIG. 5.
Figure 7:
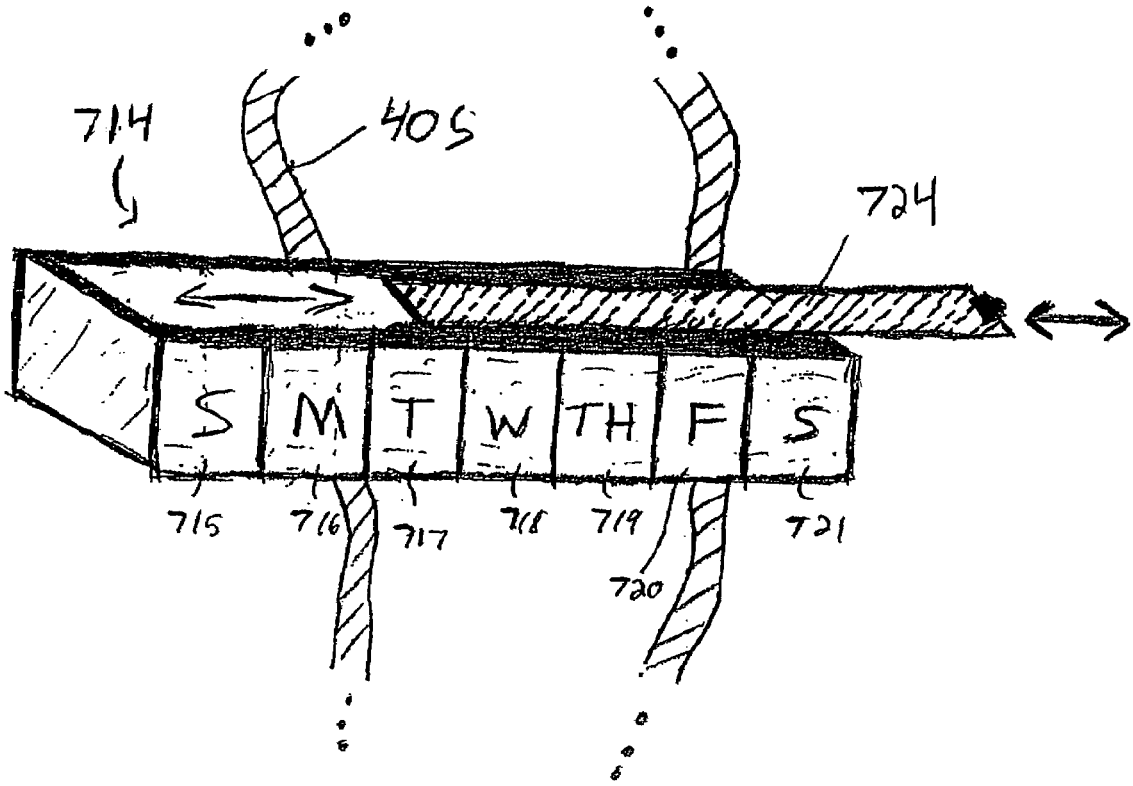
FIG. 7 is a more detailed, perspective view of the elongated compartment illustrated in FIG. 4 according to another embodiment of the present invention.
Figure 8:
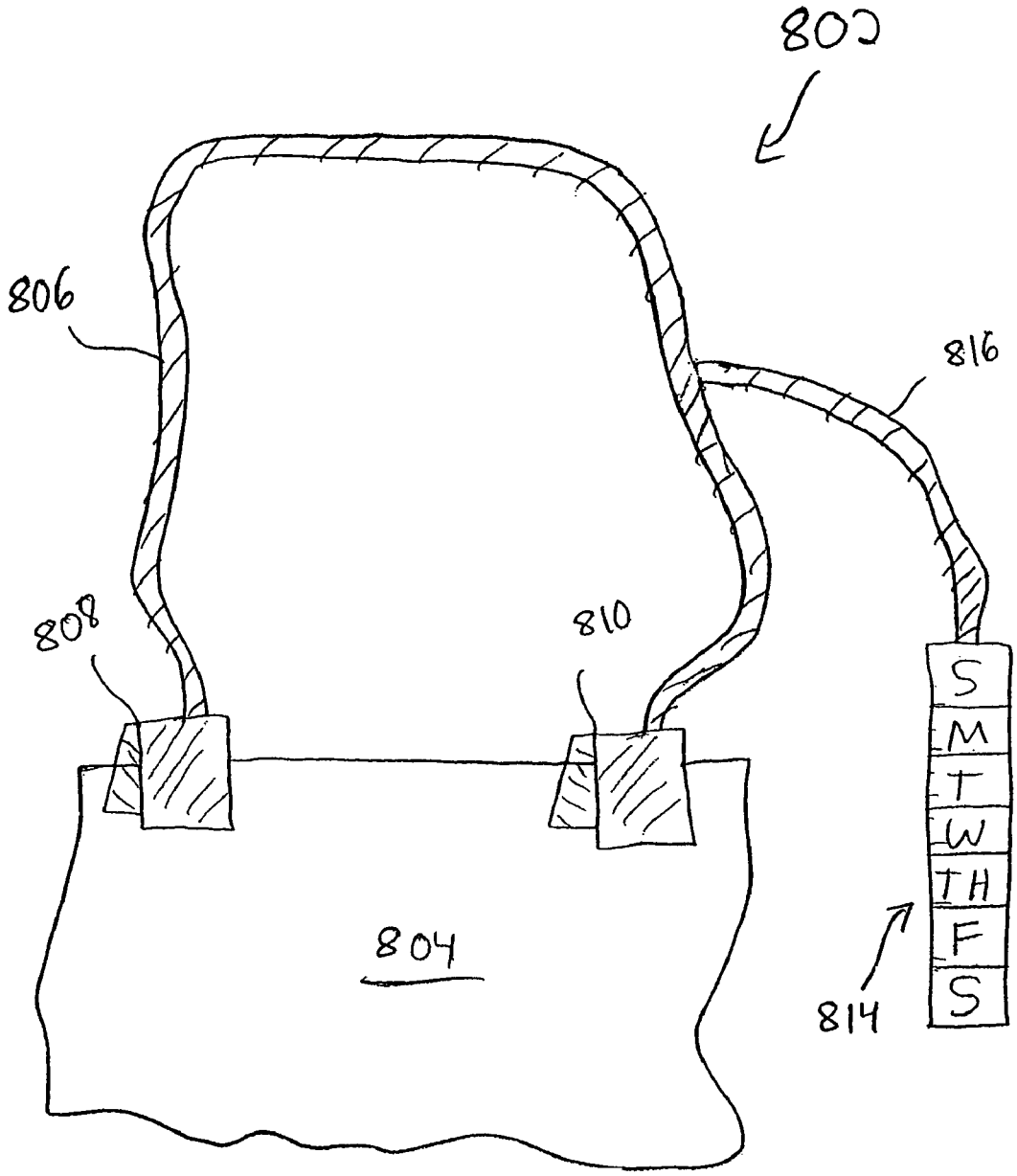
FIG. 8 illustrates another embodiment of a bib holder constructed in accordance with the present invention.

FIG. 6 shows a cross-sectional view of elongated compartment 414 shown in FIGS. 7-8. In the embodiment of the invention shown in FIG. 6, sub-compartments 415-421 comprise respective wells 615-621. As explained above, however, the invention encompasses various methods of forming sub-compartments 415-421, and is not limited in this manner.

FIG. 7 shows a perspective view of another type of elongated compartment 714 that can be used in a bib holder according to the present invention. Similar to elongated compartment 414 described above, elongated compartment 714 includes seven sub-compartments 715-721. Instead of using hinged-lids for each of sub-compartments 715-721 (as is the case for elongated compartment 414), however, elongated compartment 714 uses a single sliding lid 724 to cover sub-compartments 715-721. In this manner, a person using a bib holder that includes elongated compartment 714 can displace sliding lid 724 to access any medicine pills or other items located in any of sub-compartments 715-721. Sliding lid 724 can comprise a reflective surface and function as a miniature mirror for any desired purpose. For example, such a person can use sliding lid 724 to view one's teeth following a meal, or for some other purpose (cosmetic or otherwise). According to one embodiment of the present invention, sliding lid 724 locks into place when fully inserted into elongated compartment 714 such that the likelihood of accidental removal is eliminated or at least substantially reduced. Additionally, in various embodiments of the present invention, a stopper is used to prevent the complete removal of sliding lid 724 from the remainder of elongated compartment 714.

While having a reflective surface can be beneficial for several reasons, sliding lid 724 need not have such a reflective surface as shown in FIG. 7. In addition, according to another embodiment of the present invention in which a stopper is not used, elongated compartment 714 can be constructed such that sliding lid 724 can also be inserted "upside down" to hide the reflective surface. In this manner, a person can alternate as desired between a reflective surface and a non-reflective surface for the top portion of elongated compartment 714.

FIG. 8 shows another embodiment of a bib holder 802 according to the present invention that can be used to secure a bib 804 in place. As shown in FIG. 8, bib holder 802 includes a strap 806 and fasteners 808 and 810. Bib holder 802 also includes an elongated compartment 814, which can be similar to either elongated compartment 414 or 714 described above, attached to strap 806 using a secondary strap 816. It will be understood that the invention is not limited by the particular connection of elongated compartment 814 to strap 806. Additionally, other types of compartments can also be used in place of elongated compartment 814. For example, elongated compartment 814 shown in FIG. 8 can be replaced by a compartment such as compartment 116 or compartment 118 as described above in connection with FIG. 1.

Figure 9:
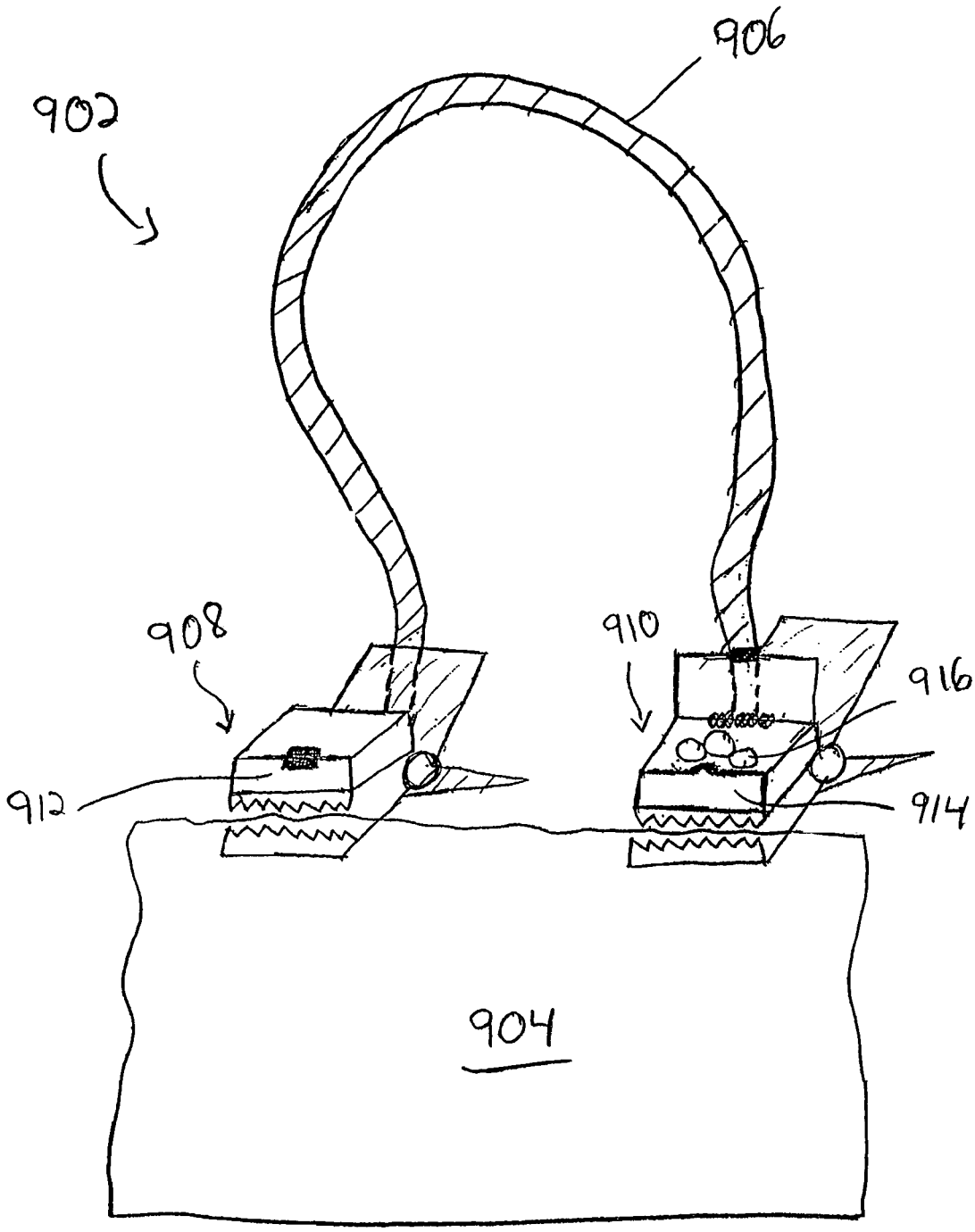
FIG. 9 illustrates yet another embodiment of a bib holder constructed in accordance with the present invention.

FIG. 9 shows yet another embodiment of a bib holder 902 according to the present invention that can be used to secure a bib 904 in place. As shown in FIG. 9, bib holder 902 includes a strap 906 and fasteners 908 and 910. It will be appreciated that, although fasteners 908 and 910 are shown to be teethed clips in FIG. 9, the invention is not limited in this manner.

As shown in FIG. 9, fasteners 908 and 910 include compartments 912 and 914 inside of which one or more medicine pills 916 or other items can be retained. It will be understood that other types of fasteners which include compartments such as compartments 912 and 914 can also be used in accordance with the present invention. For example, one or more fasteners such as fasteners 108 or 110 of FIG. 1 can be used, which also can include compartments 912 and 914 in accordance with the present invention. Additionally, although not shown in FIG. 9, either or both of compartments 912 and 914 can comprise one or more partitions forming sub-compartments having separate or shared lids. In this manner, for example, medicine (e.g., pills) intended to be consumed on different days can be separated from one another. In yet other embodiments of the present invention, moreover, fasteners 908 and 910 can be modified to include one or more reflective surfaces.

It will be understood that, while compartments 912 and 914 can be situated within fasteners 908 and 910, respectively, as shown in FIG. 9, the invention is not limited in this manner. Rather, compartments 912 and 914 can also be located at any suitable region of fasteners 908 and 910 (e.g., underneath, inside of, or on top of fasteners 908 and 910).

Figure 10:
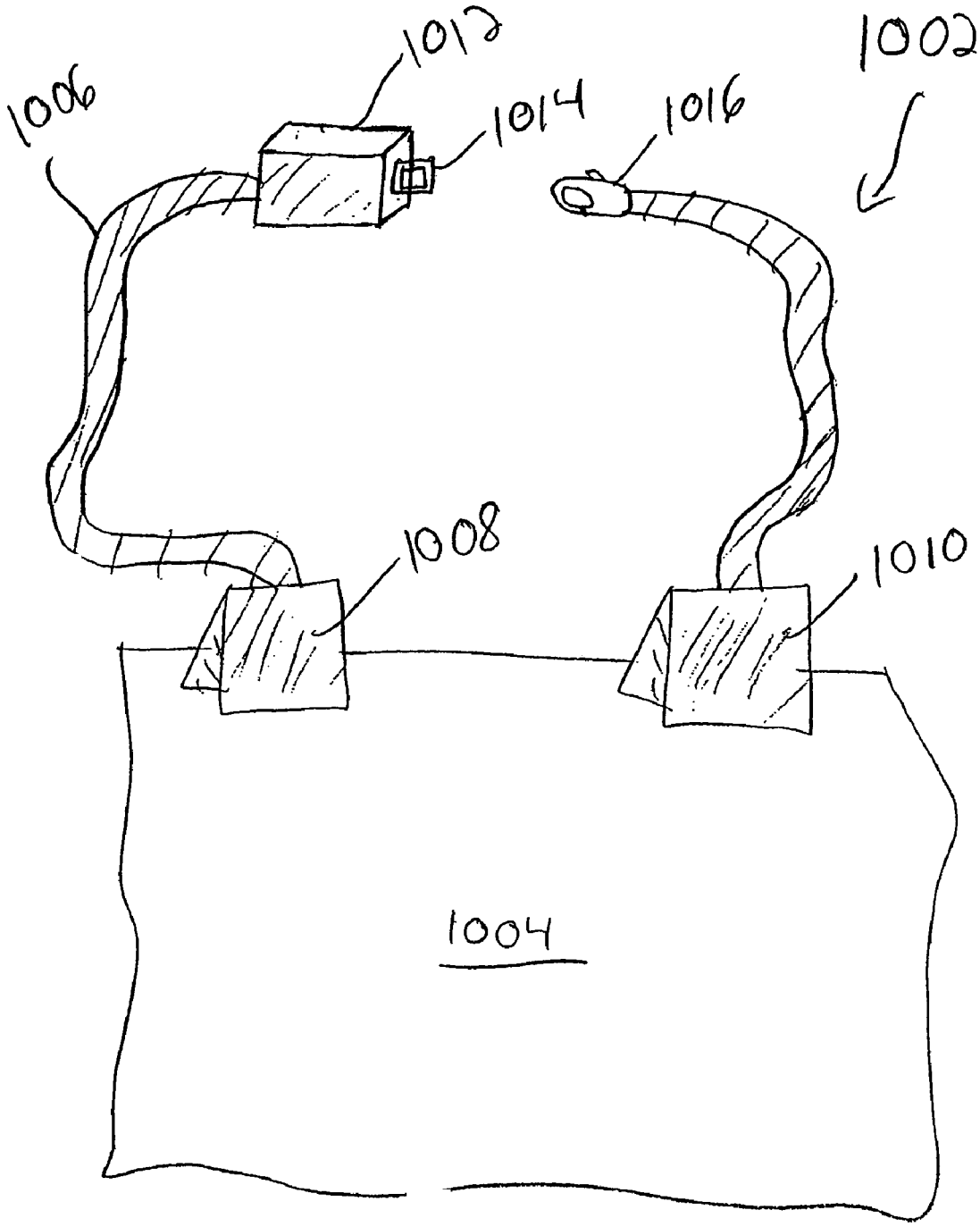
FIG. 10 illustrates still another embodiment of a bib holder constructed in accordance with the present invention.

FIG. 10 shows a bib holder 1002 according to another embodiment of the present invention that is used to secure a bib 1004 in place. As shown in FIG. 10, bib holder 1002 includes a strap 1006 and fasteners 1008 and 1010 on either side of strap 1006. According to the present invention, bib holder 1002 also includes a connection compartment 1012 that, similar to compartments 116 and 118 described above in connection with FIG. 1, can be used for storing medicine pills or other suitable items. As shown in FIG. 10, moreover, connection compartment 1012 includes a radially protruding link 1014 to which clasp 1016 can be attached when securing bib holder 1002 around a person's neck. While a particular method of attachment is shown in FIG. 10, the invention is not limited in this manner. For example, compartment 1012 shown in FIG. 10 can include another link on the opposite side of link 1014, whereby an additional clasp can be used to connect that side of strap 1006 to compartment 1012. In this manner, compartment 1012 is completely detachable from strap 1012 and bib holder 1002. Additionally, for, for example, compartment 1014 can have permanent attachments on either side to strap 1006. The invention is not limited in this manner.

Figure 11:
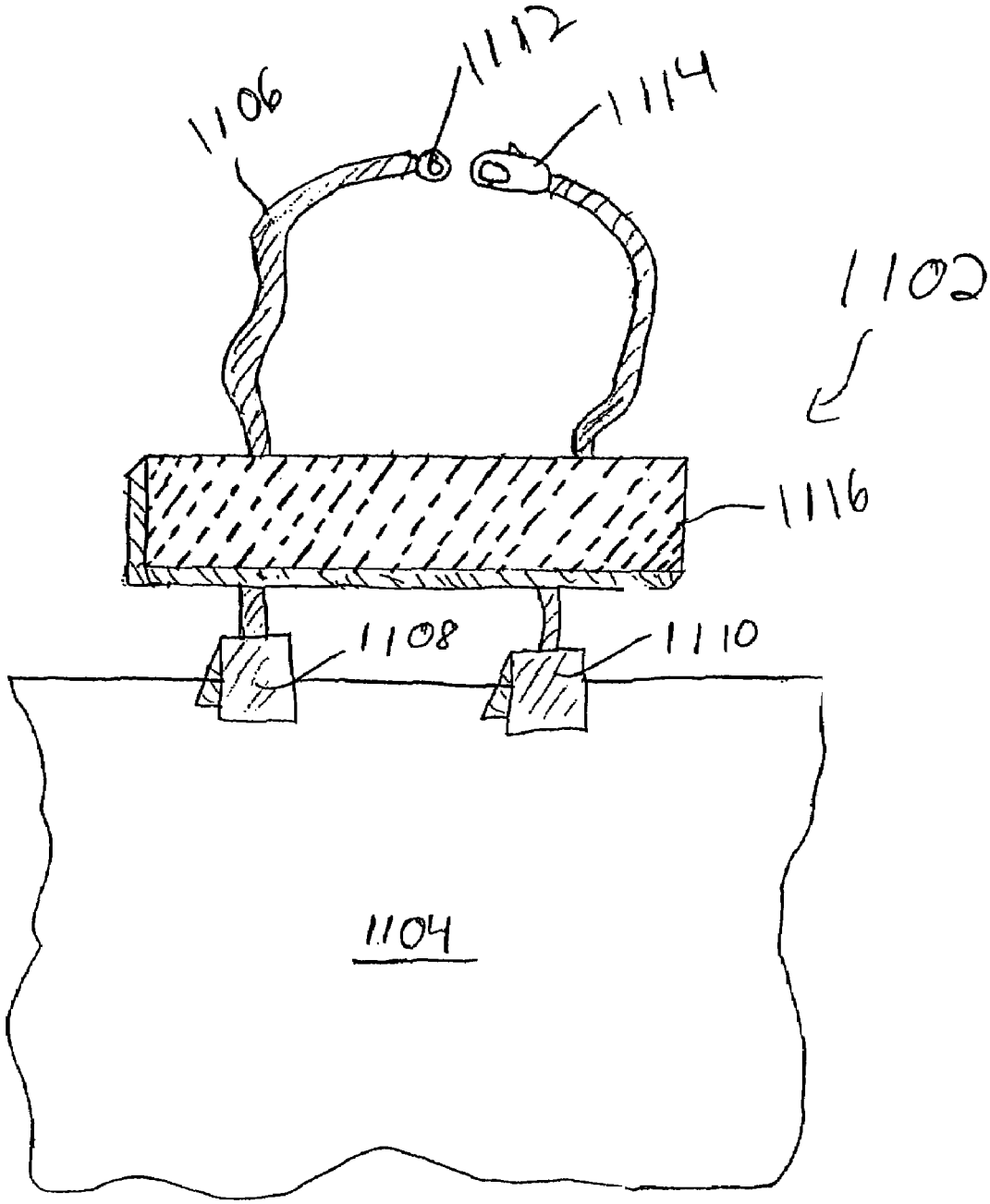
FIG. 11 illustrates still another embodiment of a bib holder constructed in accordance with the present invention.

FIG. 11, meanwhile, shows another embodiment of a bib holder 1102 according to the present invention that can be used to secure a bib 1104 in place. Similar to bib holder 402 of FIG. 4 described above, bib holder 1102 includes a strap 1106 and fasteners 1108 and 1110 that are used to retain bib 1104. Moreover, bib holder 1102 also includes a link 1112 and a clasp 1114. It will be understood, however, that bib holder 1102 can comprise additional links, and other modifications such as described above can be made that are within the scope of the present invention.

As shown in FIG. 11, bib holder 1102 also includes a non-storable, reflective component 1116 attached to strap 1106. Reflective component 1116 can be a thin reflective sheet of plastic or glass, or any other suitable construction that would permit a person using bib holder 1102 to view reflections of desired items using reflective component 1116. In various embodiments of the present invention, moreover, both the upper and lower surfaces of component 1116 (only the upper surface is shown in FIG. 11) can have reflective surfaces. In other embodiments, meanwhile, only one surface, a portion of one surface, or a portion of both surfaces can have reflective surfaces. The invention is not limited in this manner, nor by the particular size or shape of reflective component 1116, or by the particular manner in which component 1116 is attached to strap 1106 or fasteners 1108 and 1110. In other embodiments of the present invention, moreover, one or more compartments such as described above can be included in bib holder 1102.

Although the invention has been described and illustrated in the foregoing illustrative embodiments, it is understood that the present disclosure has been made only by way of example, and that numerous changes in the details of implementation of the invention can be made without departing from the spirit and scope of the invention. For example, the various compartments described above can include one or more slits (or translucent or transparent portions) that would permit a person to see if the compartments are retaining any items. Moreover, while indicia in the form of writing has been described above, it will be understood that other forms of indicia, such as pictures (e.g., of the intended user of a particular bib holder) can be found on the exterior (or interior) of such compartments.

It should be noted that, for the embodiments of the present invention including one or more compartments for storing items, the particular construction of these compartments can vary based on the desired method of opening the compartments. For example, a person suffering from an arthritic condition can have greater difficulty using a thumb compared to one or more fingers, or vice versa. The invention is able to compensate for such difficulties by using compartments designed to be opened in a particular manner that is suitable for a given user.

Moreover, it will be understood that, depending on its expected use, a bib holder according to the invention can have various features. For example, when a bib holder according to the invention is designed to be disposable (e.g., used once and then discarded), it can be preferable to use relatively inexpensive materials. When the bib holder will be reused, however, it can be preferable to use materials that are easily cleaned and/or sterilized. Such modifications depending on use are within the scope of the present invention. Additionally, it will be understood that various features of the different embodiments described above can be combined and are within the scope of the present invention.

What is claimed is:

1. A bib holder system comprising:

a bib;

a strap having two ends;

two fasteners, each fastener being attached at a unique end of the strap and directly attached to a portion of the bib;

two or more compartments that are attached to the strap and each being configured to store one or more pills; and at least one lid capable of covering each compartment, the at least one lid being movable such that each compartment can be independently opened or closed and, when closed, the one or more pills cannot escape from the closed compartment.

2. The bib holder system of claim 1, wherein an end of the strap is branched into at least two termini, and a fastener is attached to at least one of the termini.

3. The bib holder system of claim 1, wherein the bib is made of cloth or plastic.

4. The bib holder system of claim 1, wherein at least a portion of the strap is elastic.

5. The bib holder system of claim 1, wherein the strap is a string of beads.

6. The bib holder system of claim 1, wherein the strap is formed from at least one of plastic, rope, metal and rubber.

7. The bib holder system of claim 1, wherein at least one of the fasteners is releasable from the bib.

8. The bib holder system of claim 1, wherein the strap comprises a link and a clasp.

9. The bib holder system of claim 1, wherein at least a portion of the surface of the compartments is reflective.

10. The bib holder system of claim 1, wherein at least a portion of the surface of the compartments comprises an indicium.

11. The bib holder system of claim 1, wherein the interior of the compartments comprises an indicium.

12. The bib holder system of claim 1, wherein the fastener is releasably attached to a portion of the bib.

13. A bib holder system comprising:

a bib;

a strap having two ends;

a fastener that is attached at one of the two ends and is directly attached to a portion of the bib;

two or more compartments that are attached to the strap and each being configured to store one or more pills; and at least one lid capable of covering each compartment, the at least one lid being movable such that each compartment can be independently opened or closed and, when closed, the one or more pills cannot escape from the closed compartment.

14. The bib holder system of claim 13, wherein the bib is made of cloth or plastic.

15. The bib holder system of claim 13, wherein the fastener is releasably attached to a portion of the bib.

16. A bib holder comprising:

a strap having two ends; and two fasteners, each fastener being attached at a unique end of the strap, wherein at least one of the fasteners comprises a compartment.

17. A bib attached to at least one of the fasteners of the bib holder of claim 16.

18. The bib holder of claim 16, wherein the compartment is partitioned and comprises a plurality of sub-compartments.

19. The bib holder of claim 16, wherein at least a portion of the surface of the compartment is reflective.

20. A bib holder system comprising:

a bib;

a strap having two ends;

two fasteners, each fastener attached at a unique end of the strap and directly attached to a portion of the bib;

two or more compartments that are attached to the strap, and each being configured to store one or more pills wherein, when each compartment is closed, the one or more pills cannot escape from each closed compartment and wherein the compartments have a reflective component located proximate one end of the strap.

21. The bib holder system of claim 20, wherein the bib is made of cloth or plastic.

22. The bib holder system of claim 20, wherein the fastener is releasably attached to a portion of the bib.

23. A bib holder system comprising:

a bib;

a circular strap that is capable of encircling the neck of a wearer of the bib holder;

a fastener that is attached to the strap and directly attached to a portion of the bib;

two or more compartments that are attached to the strap and each being configured to store one or more pills; and at least one lid capable of covering each compartment, the at least one lid being movable such that each compartment can be opened or closed independently and, when closed, the one or more pills cannot escape from the closed compartments.

24. The bib holder system of claim 23, wherein the circular strap comprises a link and a clasp.

25. The bib holder system of claim 23, wherein the bib is made of cloth or plastic.

26. The bib holder system of claim 23, wherein the fastener is releasably attached to a portion of the bib.

* * * * *

UNITED STATES PATENT AND TRADEMARK OFFICE

CERTIFICATE OF CORRECTION

PATENT NO. : 7,320,156 B1
APPLICATION NO. : 10/913254
DATED : January 22, 2008
INVENTOR(S) : Emily Slayton It is certified that error appears in the above-identified patent and that said Letters Patent is hereby corrected as shown below:

Please change illustration on front page from illustration # 2 to illustration # 9.

Signed and Sealed this

Thirtieth Day of December, 2008

JON W. DUDAS
*Director of the United States Patent and Trademark Office*

(12) United States Patent
Slayton

(10) Patent No.: US 7,320,156 B1
(45) Date of Patent: Jan. 22, 2008

(54) BIB HOLDER INCORPORATING A COMPARTMENT

(76) Inventor: Emily Slayton, 370 E. 76th St., New York, NY (US) 10021

( * ) Notice: Subject to any disclaimer, the term of this patent is extended or adjusted under 35 U.S.C. 154(b) by 60 days.

(21) Appl. No.: 10/913,254

(22) Filed: Aug. 6, 2004

Related U.S. Application Data

(60) Provisional application No. 60/582,637, filed on Jun. 23, 2004.

(51) Int. Cl.
*A45F 5/04* (2006.01)
*A44B 21/00* (2006.01)

(52) U.S. Cl. ..... 24/7; 24/298; 24/302

(58) Field of Classification Search ..... 24/3.1, 24/3.4, 3.7, 3.8, 3.13, 7, 298–302
See application file for complete search history.

(56) References Cited

U.S. PATENT DOCUMENTS

| | | | | | |
|---|---|---|---|---|---|
| 211,479 | A | * | 1/1879 | Shelby | 2/335 |
| 1,184,311 | A | * | 5/1916 | Bock | 224/222 |
| 1,418,371 | A | * | 6/1922 | Foster | 224/182 |
| 4,446,574 | A | * | 5/1984 | Kalomeris | 2/338 |
| 5,201,073 | A | * | 4/1993 | Spanier | 2/49.2 |
| 5,313,669 | A | * | 5/1994 | Rasdell et al. | 2/323 |
| 5,540,366 | A | * | 7/1996 | Coomber | 224/677 |
| 5,692,246 | A | * | 12/1997 | Benedick | 2/463 |
| H1738 | H | * | 7/1998 | Reinhart, Jr. | 2/49.1 |
| 5,839,932 | A | * | 11/1998 | Pierce et al. | 441/80 |
| 5,852,849 | A | | 12/1998 | Lansing et al. | 24/3.4 |
| 5,871,132 | A | * | 2/1999 | Hargreaves | 2/46 |
| 5,913,478 | A | | 6/1999 | Ochsman | 24/7 |
| 5,938,089 | A | * | 8/1999 | Abreu-Marston | 224/148.5 |
| 6,182,335 | B1 | | 2/2001 | Juda et al. | 24/7 |
| 6,325,260 | B1 | * | 12/2001 | Gorham | 224/222 |
| 6,371,346 | B1 | * | 4/2002 | Sharma | 224/578 |
| 6,502,284 | B2 | | 1/2003 | Juda et al. | 24/7 |
| 6,718,554 | B1 | * | 4/2004 | Langston | 2/49.1 |

* cited by examiner

*Primary Examiner*—James R. Brittain
*Assistant Examiner*—Ruth C. Rodriguez
(74) *Attorney, Agent, or Firm*—Wilmer Cutler Pickering Hale and Dorr LLP

(57) ABSTRACT

A bib holder is provided that is useful for securing a bib in place. In one embodiment, the bib holder includes a strap and at least one fastener that is useful for retaining the bib, in addition to at least one compartment that is capable of storing an item of suitable size and weight. The compartment can be attached to the strap, or be a part of the fastener. In various embodiments, at least a portion of the surface of the compartment is reflective. Additionally, the compartment of the bib holder can optionally include indicia thereon. In certain embodiments of the invention, moreover, the compartment includes a plurality of sub-compartments.

26 Claims, 11 Drawing Sheets

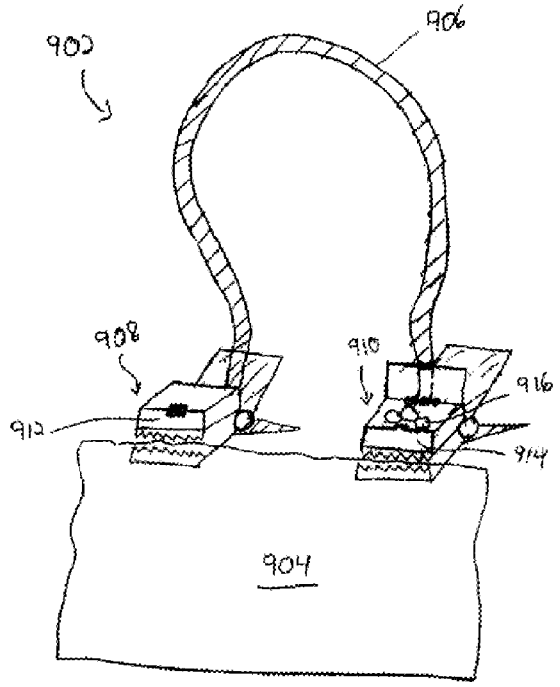

UNITED STATES PATENT AND TRADEMARK OFFICE

CERTIFICATE OF CORRECTION

PATENT NO. : 7,320,156 B1
APPLICATION NO. : 10/913254
DATED : January 22, 2008
INVENTOR(S) : Emily Slayton It is certified that error appears in the above-identified patent and that said Letters Patent is hereby corrected as shown below:

Delete the title page displaying illustrative Figure 2 and substitute therefor the corrected title page displaying illustrative Figure 9.

This certificate supersedes the Certificate of Correction issued December 30, 2008.

Signed and Sealed this

Twenty-fourth Day of February, 2009

JOHN DOLL
*Acting Director of the United States Patent and Trademark Office*

(12) United States Patent
Slayton

(10) Patent No.: US 7,320,156 B1
(45) Date of Patent: Jan. 22, 2008

(54) BIB HOLDER INCORPORATING A COMPARTMENT

(76) Inventor: Emily Slayton, 370 E. 76th St., New York, NY (US) 10021

( * ) Notice: Subject to any disclaimer, the term of this patent is extended or adjusted under 35 U.S.C. 154(b) by 60 days.

(21) Appl. No.: 10/913,254

(22) Filed: Aug. 6, 2004

Related U.S. Application Data

(60) Provisional application No. 60/582,637, filed on Jun. 23, 2004.

(51) Int. Cl.
*A45F 5/04* (2006.01)
*A44B 21/00* (2006.01)

(52) U.S. Cl. ..... 24/7; 24/298; 24/302

(58) Field of Classification Search ..... 24/3.1, 24/3.4, 3.7, 3.8, 3.13, 7, 298–302
See application file for complete search history.

(56) References Cited

U.S. PATENT DOCUMENTS

| | | | | | |
|---|---|---|---|---|---|
| 211,479 | A * | 1/1879 | Shelley | | 2/335 |
| 1,184,311 | A * | 5/1916 | Bock | | 224/222 |
| 1,418,371 | A * | 6/1922 | Foster | | 224/182 |
| 4,446,574 | A * | 5/1984 | Kalomeris | | 2/338 |
| 5,201,072 | A * | 4/1993 | Spanier | | 2/49.2 |
| 5,313,669 | A * | 5/1994 | Rendell et al. | | 2/325 |
| 5,540,366 | A * | 7/1996 | Coomber | | 224/677 |
| 5,692,246 | A * | 12/1997 | Benedick | | 2/463 |
| H1738 | H * | 7/1998 | Reinhart, Jr. | | 2/49.1 |
| 5,839,932 | A * | 11/1998 | Pierce et al. | | 441/80 |
| 5,852,849 | A | 12/1998 | Lansing et al. | | 24/3.6 |
| 5,871,132 | A * | 2/1999 | Hargreaves | | 2/46 |
| 5,913,478 | A | 6/1999 | Oshman | | 24/7 |
| 5,938,089 | A * | 8/1999 | Abreu-Marston | | 224/148.5 |
| 6,182,335 | B1 | 2/2001 | Juda et al. | | 24/7 |
| 6,325,260 | B1 * | 12/2001 | Gorham | | 224/232 |
| 6,371,348 | B1 * | 4/2002 | Sharma | | 224/578 |
| 6,502,284 | B2 | 1/2003 | Juda et al. | | 24/7 |
| 6,718,554 | B1 * | 4/2004 | Langston | | 2/49.1 |

* cited by examiner

*Primary Examiner*—James R. Brittain
*Assistant Examiner*—Ruth C. Rodriguez
(74) *Attorney, Agent, or Firm*—Wilmer Cutler Pickering, Hale and Dorr LLP

(57) ABSTRACT

A bib holder is provided that is useful for securing a bib in place. In one embodiment, the bib holder includes a strap and at least one fastener that is useful for retaining the bib, in addition to at least one compartment that is capable of storing an item of suitable size and weight. The compartment can be attached to the strap, or be a part of the fastener. In various embodiments, at least a portion of the surface of the compartment is reflective. Additionally, the compartment of the bib holder can optionally include indicia thereon. In certain embodiments of the invention, moreover, the compartment includes a plurality of sub-compartments.

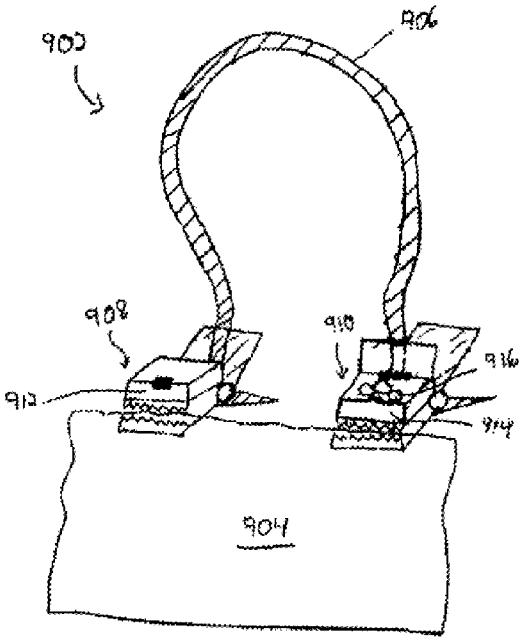

26 Claims, 11 Drawing Sheets